US012290099B2

(12) United States Patent
Hu et al.

(10) Patent No.: US 12,290,099 B2
(45) Date of Patent: May 6, 2025

(54) ATOMIZING DEVICE AND ELECTRONIC CIGARETTE

(71) Applicant: SHENZHEN FIRST UNION TECHNOLOGY CO., LTD., Shenzhen (CN)

(72) Inventors: Ruilong Hu, Shenzhen (CN); Xiaobo Ai, Shenzhen (CN); Zhongli Xu, Shenzhen (CN); Yonghai Li, Shenzhen (CN)

(73) Assignee: SHENZHEN FIRST UNION TECHNOLOGY CO., LTD., Shenzhen (CN)

( * ) Notice: Subject to any disclaimer, the term of this patent is extended or adjusted under 35 U.S.C. 154(b) by 378 days.

(21) Appl. No.: 17/731,363

(22) Filed: Apr. 28, 2022

(65) Prior Publication Data

US 2022/0248751 A1 Aug. 11, 2022

Related U.S. Application Data

(63) Continuation of application No. PCT/CN2020/125353, filed on Oct. 30, 2020.

(30) Foreign Application Priority Data

Oct. 30, 2019 (CN) ..... 201921849059.2

(51) Int. Cl.
*A24F 40/40* (2020.01)
*A24F 40/10* (2020.01)

(52) U.S. Cl.
CPC ..... *A24F 40/40* (2020.01); *A24F 40/10* (2020.01)

(58) Field of Classification Search
CPC ..... A24F 40/10; A24F 40/40
See application file for complete search history.

(56) References Cited

U.S. PATENT DOCUMENTS

| | | | | |
|---|---|---|---|---|
| 5,665,262 A * | 9/1997 | Hajaligol | ..... | A24F 40/46 131/194 |
| 2016/0219937 A1 | 8/2016 | Rado | | |
| 2021/0030072 A1 * | 2/2021 | Fu | ..... | H05B 3/42 |

FOREIGN PATENT DOCUMENTS

| | | | | |
|---|---|---|---|---|
| CN | 106235412 A | 12/2016 | | |
| CN | 206275175 U | 6/2017 | | |
| CN | 208300941 U | 1/2019 | | |
| CN | 209346104 U | 9/2019 | | |
| CN | 110313647 A * | 10/2019 | ..... | A24F 40/40 |
| CN | 211211433 U | 8/2020 | | |
| CN | 111789300 A * | 10/2020 | ..... | A24F 40/10 |
| WO | 2017023750 A2 | 2/2017 | | |
| WO | 2018210264 A | 11/2018 | | |
| WO | 2018228121 A | 12/2018 | | |

OTHER PUBLICATIONS

English Machine Translation of CN111789300A (Year: 2020).*

* cited by examiner

*Primary Examiner* — Michael H. Wilson
*Assistant Examiner* — Adam Z Baratz
(74) *Attorney, Agent, or Firm* — IPRO, PLLC

(57) ABSTRACT

The present application discloses an atomizing device and electronic cigarette. The atomizing device includes: a housing having an oil storage cavity and an receiving cavity communicating with the oil storage cavity, and a base assembly having a base and an atomizing core arranged on the base. The oil storage cavity arranges at one side of the receiving cavity far away from an open end of the housing. When the base assembly is in a first state that the base is detachably connected with the housing, at least a part of the base and the atomizing core are accommodated in the receiving cavity from the open end, and the atomizing core is in fluid communication with the oil storage cavity. When the base assembly is in a second state that the base is separated from the housing, the atomizing core is disposed outside the housing along with the base.

20 Claims, 14 Drawing Sheets

ATOMIZING DEVICE AND ELECTRONIC CIGARETTE

CROSS-REFERENCE TO RELATED APPLICATION

This application is based upon and claims priority to Chinese Patent Application No. 201921849059.2, filed with the Chinese Patent Office on Oct. 30, 2019, titled "ATOMIZING DEVICE AND ELECTRONIC CIGARETTE", the entire contents of which are incorporated herein by reference.

TECHNICAL FIELD

The present application relates to the technical field of smoking sets, and in particular, relates to an atomizing device and an electronic cigarette.

BACKGROUND

Electronic cigarettes are a kind of electronic product that generates smoke by heating atomizable liquid for inhaling by users. Generally, an electronic cigarette has two parts, i.e., an atomizing device and a battery assembly. The atomizing device stores atomizable liquid therein and is provided with an atomizing core for heating the atomizable liquid. The battery assembly can supply power to the atomizing core so that the atomizing core produces heat to generate a high temperature for heating the atomizable liquid. The atomizing core is prone to aging or burning out during use. As the atomizing core is usually arranged inside the atomizing device, the atomizing device needs to be disassembled as a whole when replacement with a new atomizing core is required, and the whole replacement process is rather complicated, which is unfavorable for improving the replacement efficiency.

SUMMARY

The embodiment of the present application discloses an atomizing device. The atomizing device includes: a housing having an oil storage cavity for storing atomizable liquid and a receiving cavity, wherein the receiving cavity communicates with the oil storage cavity, and the oil storage cavity being arranged at one side of the receiving cavity far away from an open end of the housing; and a base assembly comprising a base and an atomizing core being arranged on the base, wherein when the base assembly is in a first state, the base is detachably connected with the housing, and at least a part of the base and the atomizing core are accommodated in the receiving cavity from the open end, and the atomizing core is in fluid communication with the oil storage cavity; and when the base assembly is in a second state, the base is separated from the housing and the atomizing core is disposed outside the housing along with the base.

Alternatively, the base assembly further includes a metal thimble, wherein one end of the metal thimble is arranged on the base and the other end the metal thimble abuts against the atomizing core to form an atomizing cavity in the interval between the atomizing core and the inner wall of the base.

Alternatively, the housing further includes a hollow exhaust pipe with an airflow channel penetrating one end of the housing opposite to the open end, wherein when the base assembly is in the first state, the airflow channel communicates with the atomizing cavity.

Alternatively, the base assembly further includes an atomizing cover which is arranged on the base and covers the atomizing core.

Alternatively, the base includes a mounting part having an accommodating cavity and a fixing part, wherein the atomizing core is arranged in the accommodating cavity, and when the base is in the first state, the fixing part is fixed at the open end and the mounting part is inserted into the receiving cavity.

Alternatively, the mounting part and the fixing part are separate structures, and the mounting part and the fixing part are detachably connected with each other.

Alternatively, the fixing part is provided with a plug arm, and the mounting part is provided with a plug hole matched with the plug arm.

Alternatively, the base is provided with an elastic arm which is positioned spaced apart from the side wall of the base, and the base is detachably and elastically connected with the housing through the elastic arm.

Alternatively, the elastic arm is provided with a clamping protrusion, and the housing is provided with a clamping groove matched with the clamping protrusion.

Alternatively, the atomizing device further includes a fixing frame and a sealing element, wherein the fixing frame and the sealing element are arranged on one side of the oil storage cavity close to the receiving cavity, and the sealing element is sleeved on one end of the fixing frame facing away from the receiving cavity.

The embodiment of the present application further discloses an electronic cigarette. The electronic cigarette includes the atomizing device according to the embodiments of the present application described above and a battery assembly which is used for supplying power to the atomizing device.

BRIEF DESCRIPTION OF THE DRAWINGS

The implementation of objectives of the present application as well as functional characteristics and advantages of the present application will be further explained with reference to attached drawings and in combination with embodiments. One or more embodiments are illustrated by the pictures in the corresponding drawings, and these illustrative descriptions do not constitute the limitation of the embodiments. Elements with the same reference numerals in the attached drawings represent similar elements, and unless otherwise stated, the figures in the attached drawings do not constitute scale limitation.

Figure 1:
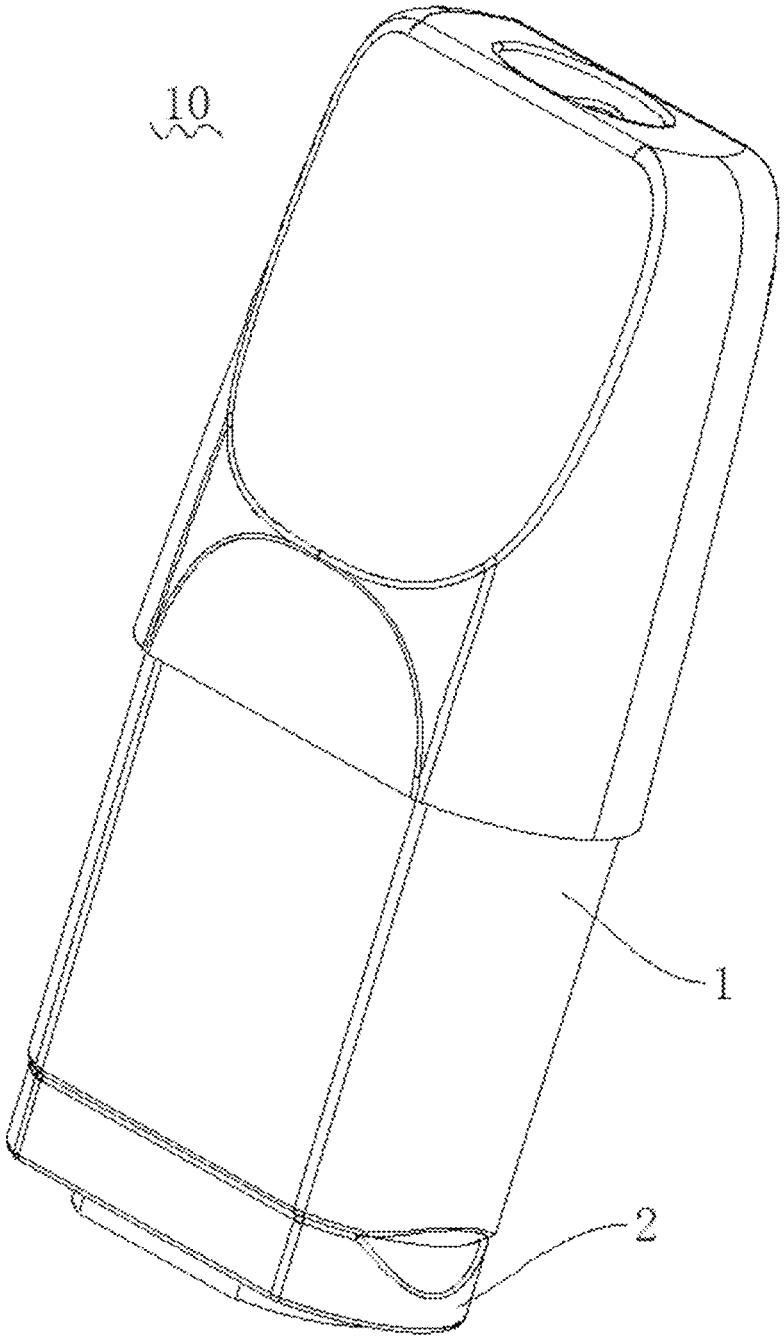
FIG. 1 is a schematic diagram of the overall structure of an atomizing device according to an embodiment of the present application.

In the attached drawings: 1. Housing; 11. Open end; 12. Suction nozzle end; 13. Oil storage cavity; 14. Exhaust pipe; 141. Airflow channel; 15. Clamping groove; 16. Clamping slot; 17. Receiving cavity; 2. Base assembly; 21. Base; 211. Mounting part; 2111. Accommodating cavity; 2112. Mounting groove; 2113. Plug hole; 212. Fixing part; 2121. Fixing hole; 2122. Mounting hole; 2123. Plug arm; 213. Elastic arm; 2131. Clamping protrusion; 214. Atomizing cavity; 22. Atomizing core; 221. Porous liquid; 222. Heating element; 23. Metal thimble; 24. Atomizing cover; 25. Sealing ring; 26. Magnet; 3. Fixing frame; 31. Oil guide hole; 32. Clamping buckle; 33. First air guide hole; 4. Sealing element; 41. Oil outlet; 42. Second air guide hole; 10. Atomizing device; 20. Battery assembly; 100. Electronic cigarette.

DETAILED DESCRIPTION

It shall be appreciated that, specific embodiments described herein are only used to explain the present application, and are not intended to limit the present application. In order to facilitate the understanding of the present application, the present application will be explained in more detail below with reference to the attached drawings and detailed description. It shall be noted that, when an element is expressed as "fixed" to another element, it may be directly on another element, or there may be one or more intervening elements therebetween. When an element is expressed as "connected" to another element, it may be directly connected to another element, or there may be one or more intervening elements therebetween. The terms "up", "down", "left", "right", "inside", "outside" and similar expressions used in this specification are only for the purpose of illustration.

Unless otherwise defined, all technical and scientific terms used in this specification have the same meanings as commonly understood by those skilled in the art of the present application. In this specification, the terms used in the specification of the present application are only for the purpose of describing specific embodiments, and are not intended to limit the present application. The term "and/or" used in this specification includes any and all combinations of one or more associated items listed.

Referring to FIG. 1 to FIG. 16, an electronic cigarette 100 according to an embodiment of the present application includes an atomizing device 10 and a battery assembly 20. The battery assembly 20 is used for supplying power to the atomizing device 10. The atomizing device 10 and the battery assembly 20 may be fixedly connected by a buckle or by screw connection, so long as it is ensured that the battery assembly 20 can stably supply power to the atomizing device 10. The atomizing device 10 includes a housing 1 and a base assembly 2.

Figure 2:
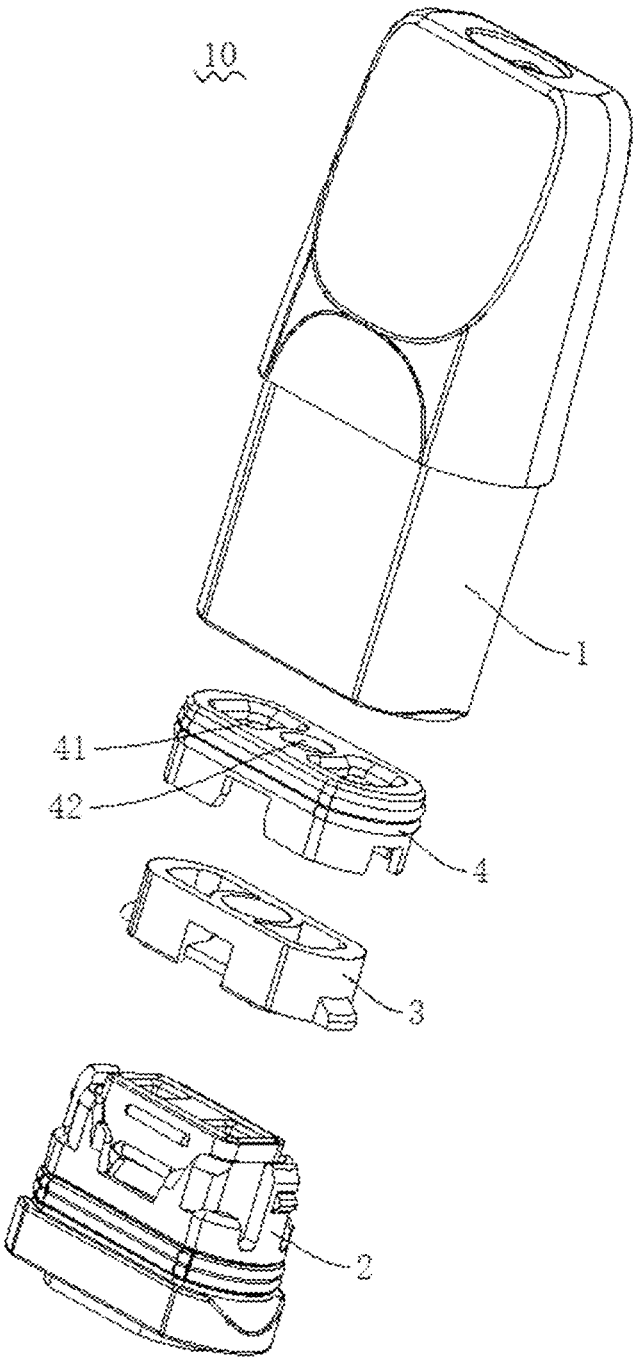
FIG. 2 is a schematic diagram of the exploded structure of the atomizing device according to an embodiment of the present application.
Figure 3:
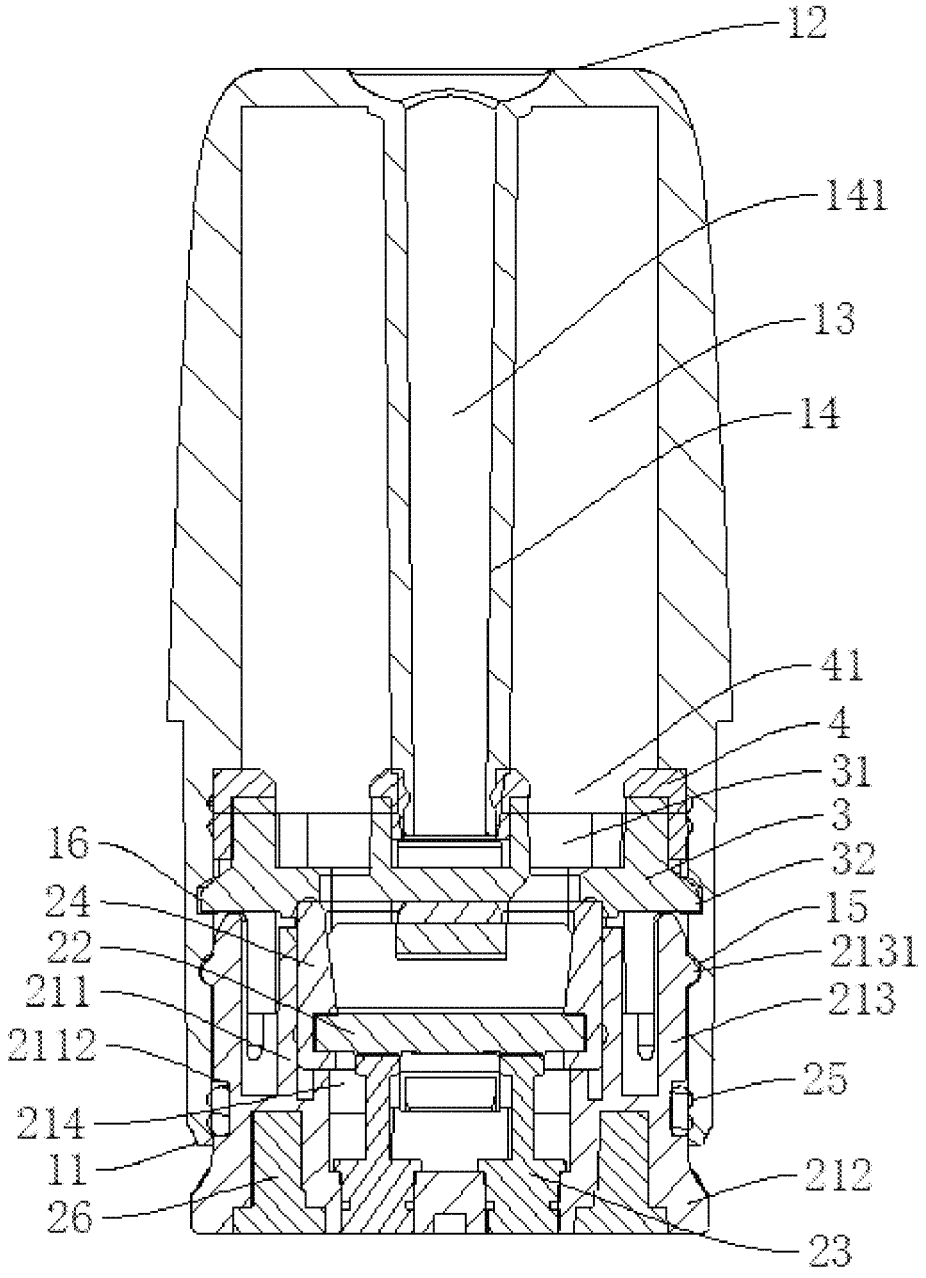
FIG. 3 is a schematic diagram of the cross-sectional structure of the atomizing device when a base assembly is in the first state according to an embodiment of the present application.
Figure 4:
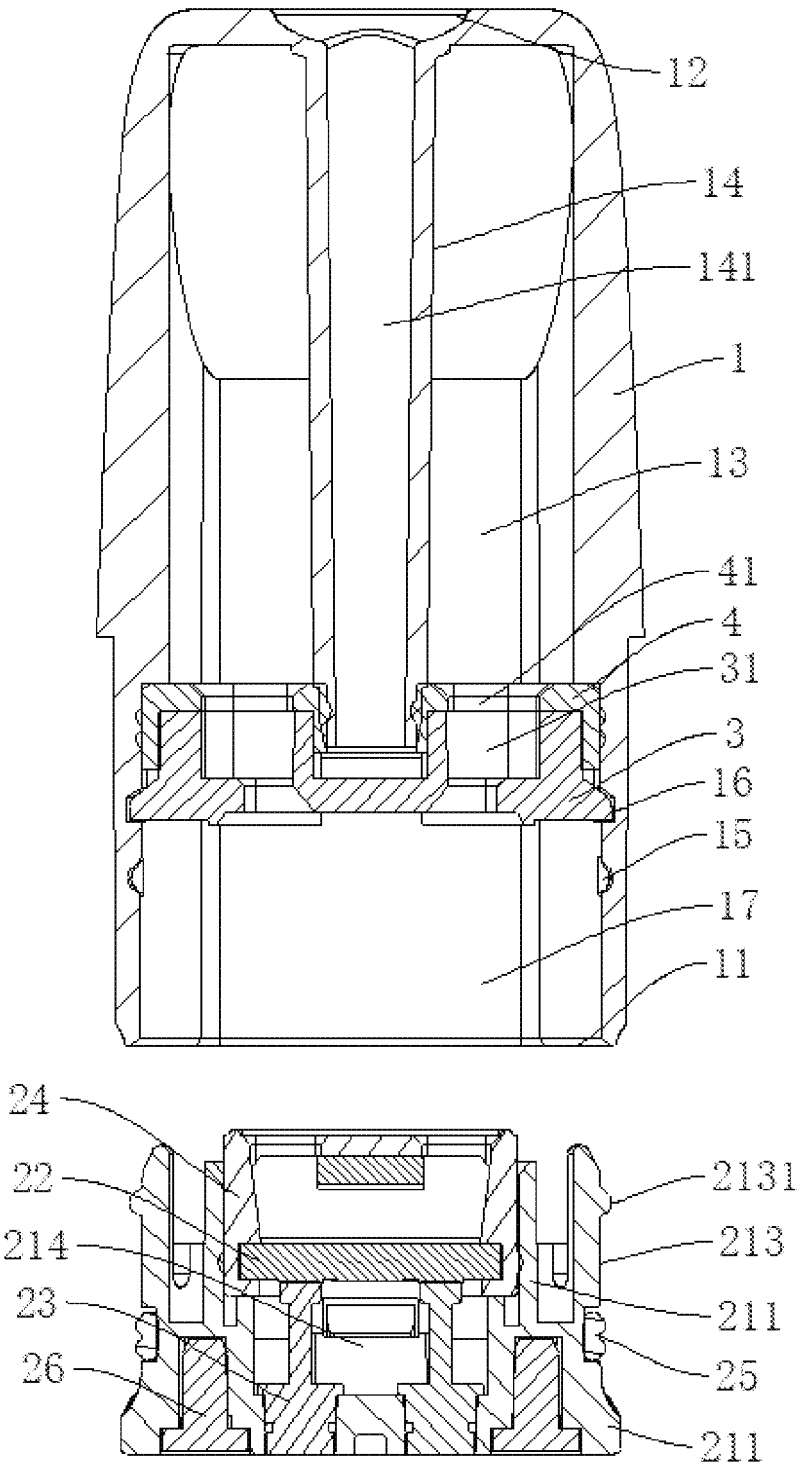
FIG. 4 is a schematic diagram of the cross-sectional structure of the atomizing device when the base assembly is in the second state according to an embodiment of the present application.
Figure 5:
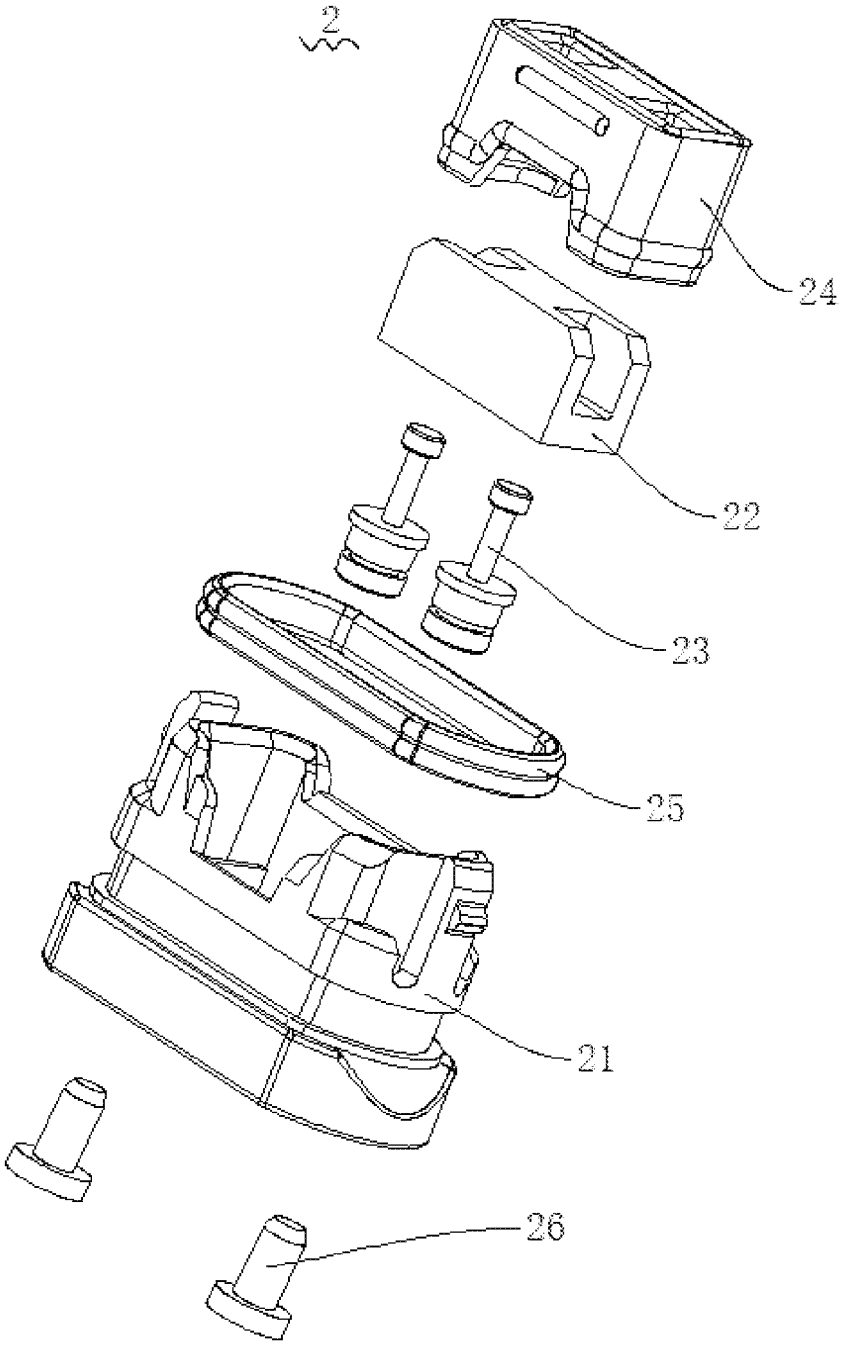
FIG. 5 is a schematic diagram of the exploded structure of a base assembly according to an embodiment of the present application.
Figure 6:
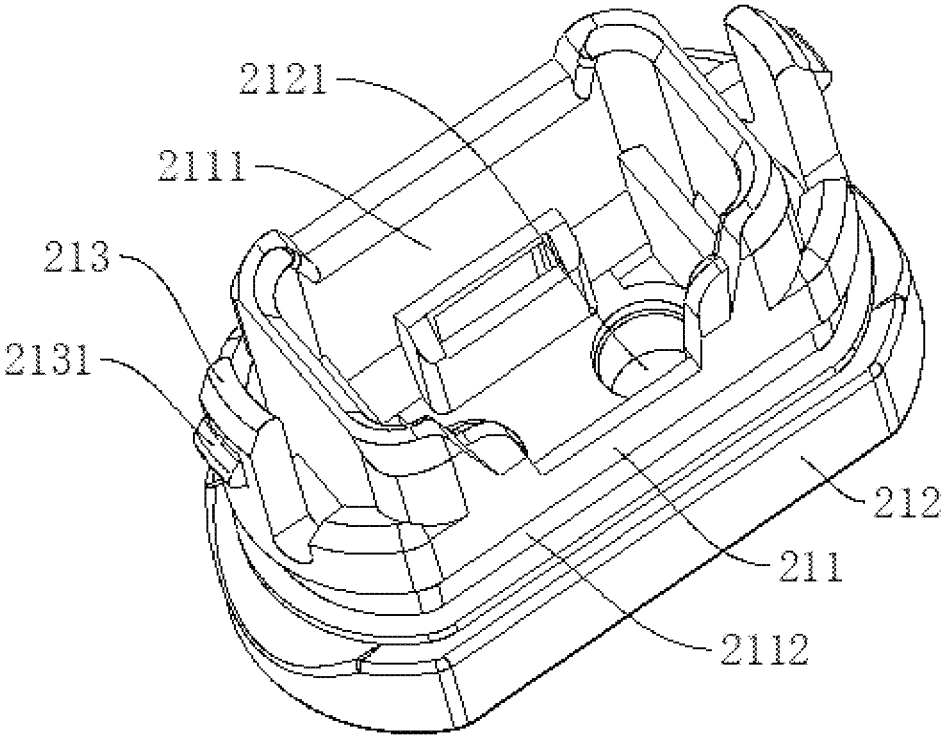
FIG. 6 is a schematic diagram of a base according to an embodiment of the present application.
Figure 7:
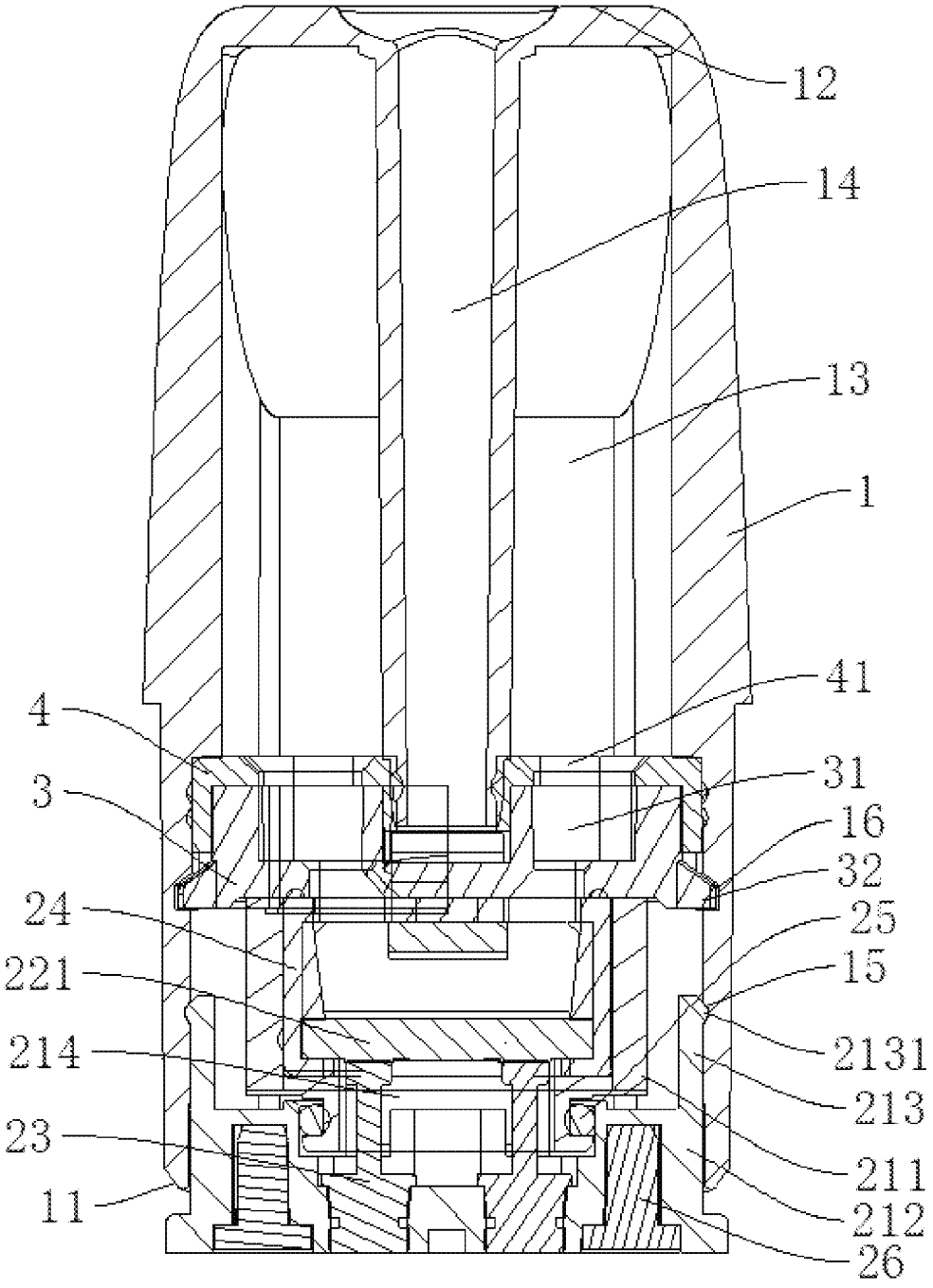
FIG. 7 is a schematic diagram of the cross-sectional structure of an atomizing device when a base assembly is in the first state according to another embodiment of the present application.
Figure 8:
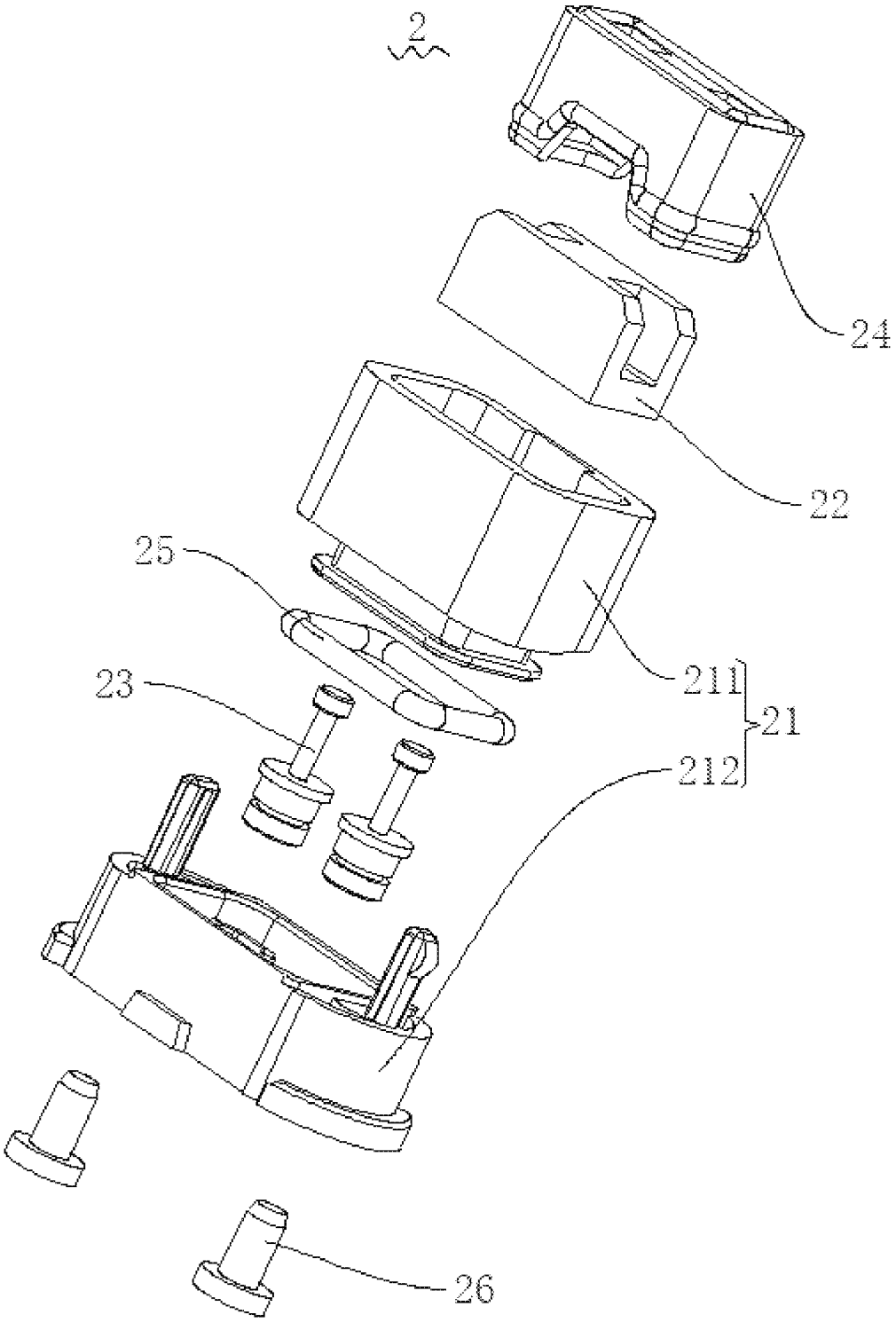
FIG. 8 is a schematic diagram of the exploded structure of the base assembly according to another embodiment of the present application.
Figure 9:
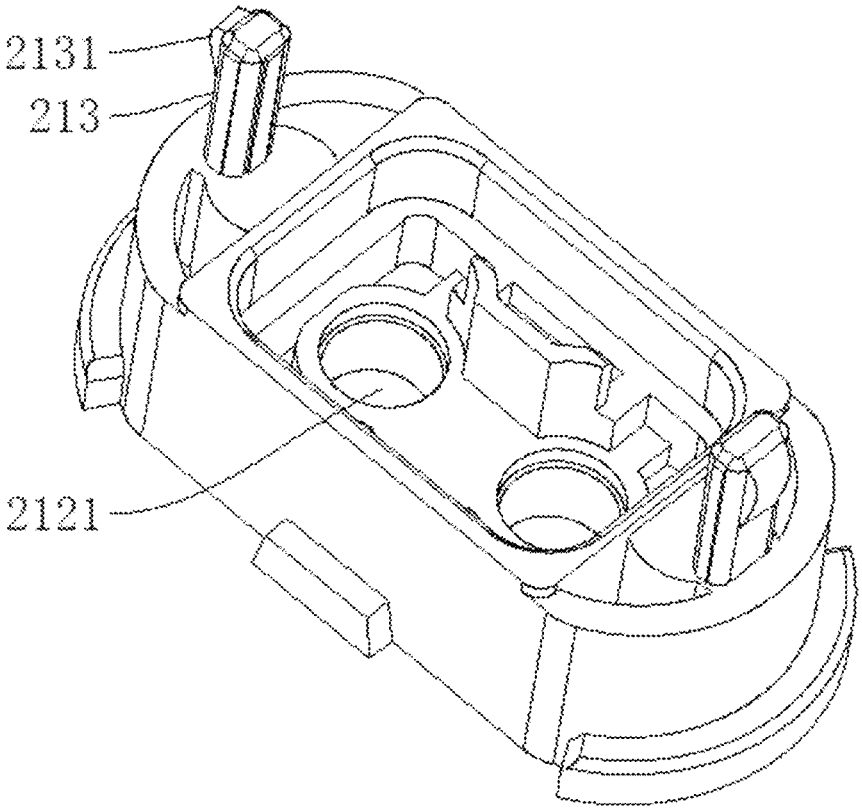
FIG. 9 is a schematic diagram of a fixing part according to another embodiment of the present application.
Figure 10:
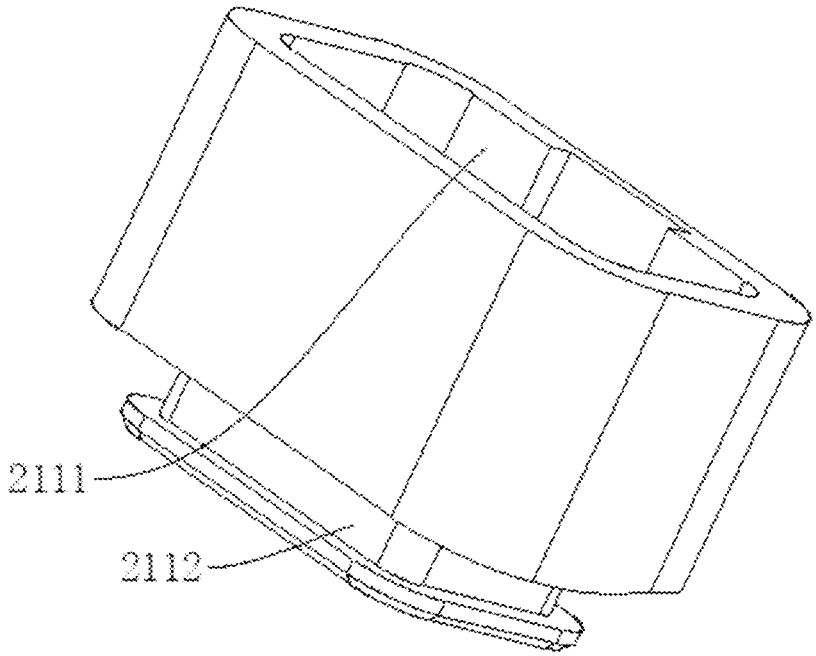
FIG. 10 is a schematic diagram of a mounting part according to another embodiment of the present application.
Figure 11:
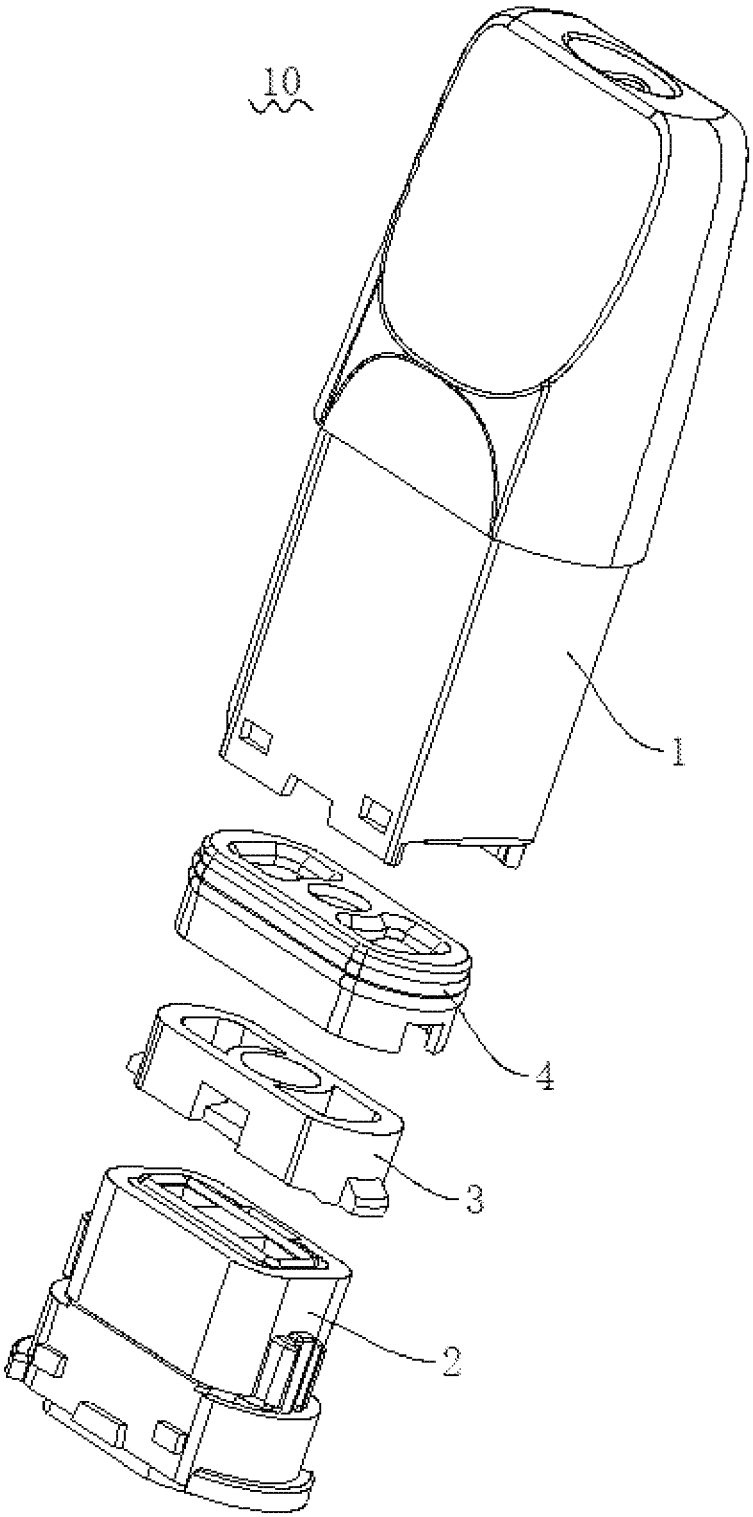
FIG. 11 is a schematic diagram of the exploded structure of an atomizing device according to yet another embodiment of the present application.
Figure 12:
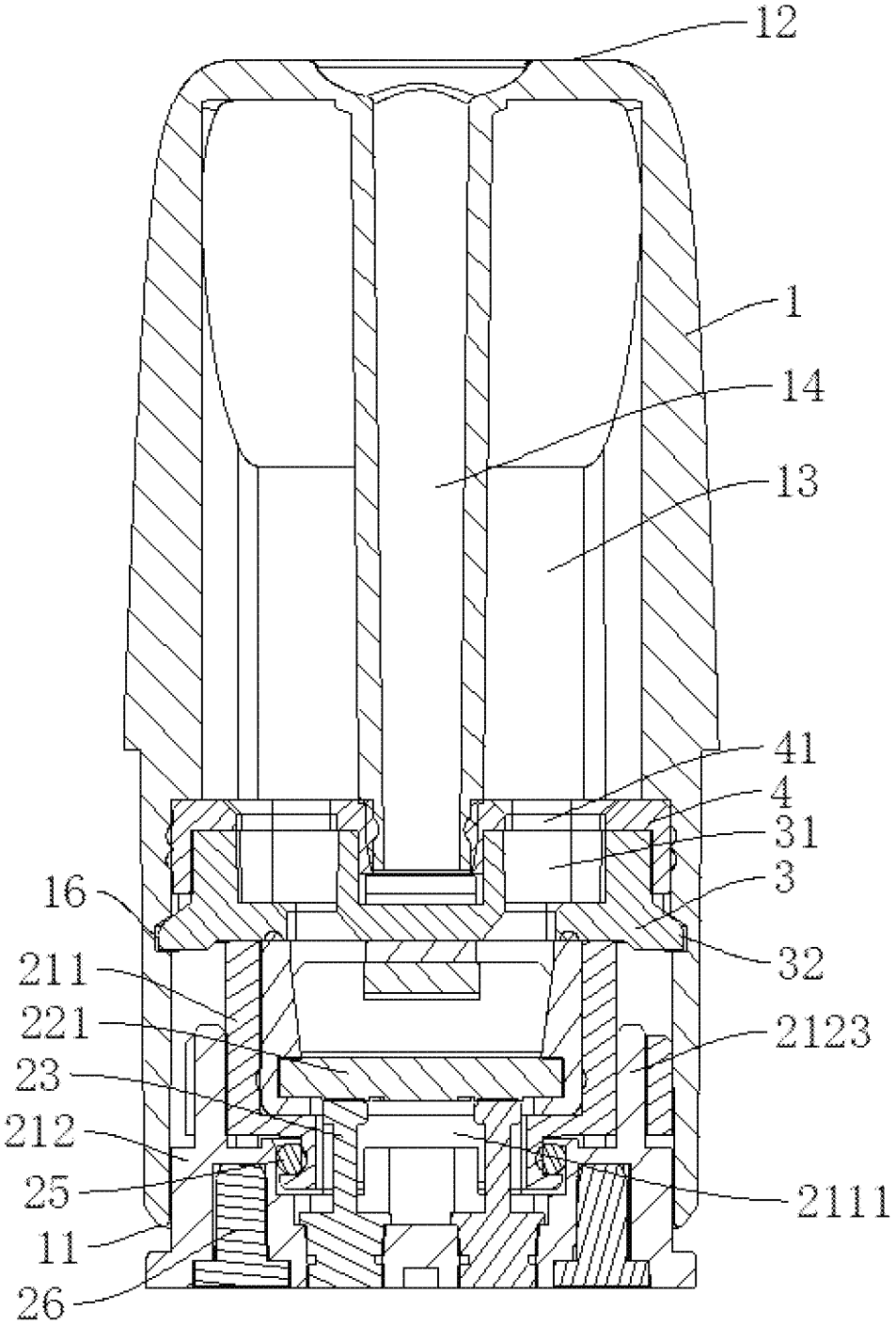
FIG. 12 is a schematic diagram of the cross-sectional structure of the atomizing device when the base assembly is in the first state according to yet another embodiment of the present application.

Referring to FIG. 1 to FIG. 5, the housing 1 has an open end 11 and a suction nozzle end 12 which are opposite ends of the housing 1. The housing 1 is further provided therein with an oil storage cavity 13 for storing atomizable liquid and a receiving cavity 17. The receiving cavity 17 communicates with the oil storage cavity 13, and the oil storage cavity 13 is arranged at one side of the receiving cavity 17 away from the open end 11. As shown in FIG. 2, the oil storage cavity 13 and the receiving cavity 17 are arranged one above the other. The base assembly 2 includes a base 21 and an atomizing core 22, and the atomizing core 22 is arranged on the base 21. The base assembly 2 is configured so that: when the base assembly 2 is in the first state that the base 21 is detachably connected with the housing 1, at least a part of the base 21 and the atomizing core 22 are accommodated in the receiving cavity 17 from the open end 11 and the atomizing core 22 is in fluid communication with the oil storage cavity 13, and when the base assembly 2 is in the second state that the base 21 is separated from the housing 1, the atomizing core 22 is disposed outside the housing 1 along with the base 21. The first state described above refers to the state where the base 21 is fixedly connected to the housing 1, and the second state described above refers to the state where the base 21 is separated from the housing 1.

For the atomizing device 10 and the electronic cigarette 100 in the above embodiment, the atomizing core 22 is arranged on the base 21 to form an independent base assembly 2, and the base assembly 2 as a whole is detachably connected with the housing 1. When the base assembly 2 is in the first state, the atomizing core 22 is disposed in the housing 1 along with the base 21 and communicates with the oil storage cavity 13, so that the atomizable liquid can flow onto the atomizing core 22 and be heated to generate smoke. When the base assembly 2 is in the second state, the atomizing core 22 is separated from the housing 1 along with the base 21, so that the base assembly 2 as a whole can be detached from the housing 1 when the atomizing core 22 is damaged and replacement with a new atomizing core 22 is required. In this way, it is unnecessary to disassemble components of the atomizing device 10 one by one, which makes the replacement operation of the atomizing core 22 very convenient and improves the working efficiency.

Referring to FIG. 1 to FIG. 2, in one embodiment, the base assembly 2 further includes a metal thimble 23. One end of the metal thimble 23 is disposed on the base 21 and the other end thereof abuts against the atomizing core 22 to form an atomizing cavity 214 in the interval between the atomizing core 22 and the inner wall of the base 21. Specifically, the housing 1 is further provided therein with an exhaust pipe 14, and the exhaust pipe 14 is hollow with an airflow channel 141 formed therein, and the airflow channel 141 is used for discharging the smoke generated by the atomizing core 22 when heating the atomizable liquid to the outside of the housing 1. The airflow channel 141 runs through the suction nozzle end 12, and when the base assembly 2 is in the first state, the airflow channel 141 communicates with the atomizing cavity 214. Since the oil storage cavity 13 is in fluid communication with the atomizing core 22 at this time, smoke can be generated in the atomizing cavity 214 when the atomizable liquid in the oil storage cavity 13 is heated after flowing onto the atomizing core 22. The smoke passes through the airflow channel 141 and is discharged from the suction nozzle end 12 of the housing 1, and then the user may inhale the smoke at the suction nozzle end 12. In this embodiment, since the atomizing core 22, the metal thimble 23 and the base 21 are an independent assembly, the atomizing core 22 and the metal thimble 23 can be taken out of the housing 1 together when the base 21 is detached from the housing 1, thereby facilitating the replacement of the atomizing core 22 and making the installation operation more convenient.

When the above-mentioned atomizing core 22 is placed in the housing 1 as the base 21 is fixedly connected with the housing 1, referring to FIG. 1 to FIG. 5, the atomizing core 22 is arranged close to the airflow channel 141, so that the smoke generated by the atomizing core 22 when heating the atomizable liquid can smoothly enter the airflow channel 141 and be taken out of the housing 1 by the circulating air in the airflow channel 141. In this embodiment, referring to FIG. 14, the atomizing core 22 includes a porous liquid 221 and a heating element 222, and the heating element 222 is arranged on the porous liquid 221. For example, the heating element 222 may be a printed circuit arranged on one surface of the porous liquid 221, or a metal wire arranged inside or outside the porous liquid 221 or the like. The porous liquid 221 is preferably made of a porous material, such as a porous ceramic body, fiber cotton or the like. In this embodiment, the heating element 222 is a printed circuit arranged on the porous liquid 221, and there are two metal thimbles 23 which respectively abut against two opposite ends of the printed circuit to realize the electrical connection with the heating element 222.

Referring to FIG. 1 to FIG. 5, in one embodiment, the base assembly 2 further includes an atomizing cover 24. The atomizing cover 24 is arranged on the base 21 and covers the atomizing core 22. Specifically, when the atomizing cover 24 covers the porous liquid 221 of the atomizing core 22 and is then installed on the base 21, the side wall of the atomizing cover 24 is in interference fit with the inner wall of the base 21, so that the atomizing cover 24 and the atomizing core 22 are fixed in the container together, and when the atomizing core 22 needs to be taken out from the base 21, the disassembly and assembly operation will be more time-saving and labor-saving. Optionally, the atomizing cover 24 is preferably made of silica gel or a rubber material so that the atomizing cover 24 has a sealing effect. When the atomizing core 22 is installed in the housing 1 along with the base 21, the atomizing cover 24 can prevent the atomizable liquid in the oil storage cavity 13 from leaking from the inner wall of the base 21, which can effectively prevent oil leaking of the atomizing device 10. More specifically, referring to FIG. 1 to FIG. 6, the base 21 described above is provided with a clamping protrusion 2131, and the housing 1 is provided thereon with a clamping groove 15 matched with the clamping protrusion 2131. The matching surface of the clamping protrusion 2131 and the clamping groove 15 is arc-shaped, and the base 21 is detachably fixed to the open end 11 of the housing 1 through the engagement of the clamping protrusion 2131 and the clamping groove 15. Of course, the clamping protrusion 2131 may also be provided on the housing 1, and correspondingly, the clamping groove 15 is provided on the base 21. Through the engagement of the clamping protrusion 2131 and the clamping groove 15, the disassembly and assembly operation of the base assembly 2 and the housing 1 become convenient. The matching surface of the clamping protrusion 2131 and the clamping groove 15 is arc-shaped, so that the clamping protrusion 2131 can be separated from the clamping groove 15 without excessive force, which is convenient for disassembly and assembly of the base 21 at the open end 11 of the housing 1. In this embodiment, the atomizing core 22 may be fixedly mounted on the base 21 first, and then fixed onto the housing 1 from the open end 11 of the housing 1 along with the base 21, and the atomizing core 22 is placed within the housing 1. In this way, when the base 21 is detached from the housing 1, the atomizing core 22 can be taken out of the housing 1 together, which is simple and convenient to operate.

Referring to FIG. 1 to FIG. 6, in a preferred embodiment, the base 21 is provided thereon with an elastic arm 213. The elastic arm 213 is positioned spaced apart from the side wall of the base 21, and the base 21 is detachably and elastically connected with the housing 1 through the elastic arm 213. Specifically, the clamping protrusion 2131 is provided on the surface of the elastic arm 213 facing away from the side wall of the base 21. Alternatively, the clamping groove 15 may also be provided on the elastic arm 213, and correspondingly, the clamping protrusion 2131 is provided on the housing 1. In the process of mounting the base 21 at the open end 11 of the housing 1, the elastic arm 213 will tilt towards the direction close to the side wall of the base 21 due to the lateral extrusion from the inner sidewall of the housing 1, and thus is elastically deformed until the clamping protrusion 2131 on the elastic arm 213 is clamped in the clamping groove 15. The clamping protrusion 2131 is closely engaged with the clamping groove 15 through the elastic action of the elastic arm 213 to fix the base 21 at the open end 11 of the housing 1. Moreover, the atomizing core 22 is also disposed in the housing 1 along with the base 21, and the atomizing core 22 is unmovable. When the atomizing core 22 needs to be replaced, a pulling force is applied to the base 21, and a lateral component force is exerted on the clamping protrusion 2131 by the clamping groove 15, so that the elastic arm 213 tilts towards the direction close to the side wall of the base 21 and thus gets deformed and the clamping protrusion 2131 is separated from the clamping groove 15. In this way, the base 21 can be pulled out from the open end 11 of the housing 1, and thus the atomizing core 22 can also be taken out of the housing 1 to be replaced with a new atomizing core 22. The whole replacement process is time-saving and labor-saving, and easy to operate.

Referring to FIG. 6, FIG. 8 to FIG. 10 and FIG. 13, in one embodiment, the base 21 includes a mounting part 211 and a fixing part 212. The mounting part 211 is provided thereon with an accommodating cavity 2111, and the atomizing core 22 is arranged in the accommodating cavity 2111. When the base 21 is in the first state, the fixing part 212 is fixed at the open end 11 of the housing 1 and the mounting part 211 is inserted into the receiving cavity 17 of the housing 1. Since the atomizing core 22 is arranged in the accommodating cavity 2111 of the mounting part 211 and is spaced apart from the bottom wall of the accommodating cavity to form the above-mentioned atomizing cavity 214, the atomizing core 22 is also inserted into the housing 1 along with the mounting part 211, so that the atomizing core 22 communicates with the oil storage cavity 13, and the atomizable liquid can smoothly flow onto the atomizing core 22 to be heated. In this embodiment, the elastic arm 213 extends from the fixing part 212 to the direction close to the inside of the housing 1, and is spaced apart from the peripheral side of the mounting part 211. During installation, the atomizing core 22 is first mounted in the accommodating cavity 2111 of the mounting part 211, and then mounted on the housing 1 together with the fixing part 212 and the mounting part 211, so that the atomizing core 22 is installed in the housing 1. When the base 21 is detached from the housing 1, the atomizing core 22 will be taken out along with the mounting part 211, and thus the operation process of replacing the atomizing core 22 of the atomizing device 10 becomes simpler. Specifically, in this embodiment, the atomizing cover 24 covers the porous liquid 221 installed with the heating element 222 and then is mounted in the accommodating cavity 2111, the peripheral surface of the atomizing cover 24 abuts against the side wall of the accommodating cavity 2111, and the atomizing cover 24 is in interference fit with the accommodating cavity 2111. In this way, the atomizing core 22 can be stably placed on the mounting part 211, and the disassembly and assembly of the atomizing core 22 on the base 21 become more convenient.

It should be noted that, referring to FIG. 1 to FIG. 6, in the above-mentioned embodiment, the mounting part 211 and the fixing part 212 is an integrally formed structure. The mounting part 211 and the fixing part 212 may be integrally formed to facilitate processing, and it is unnecessary to assemble the mounting part 211 and the fixing part 212 together during the mounting process, and the base 21 can be directly inserted into the open end 11 of the housing 1. Optionally, referring to FIG. 7 to FIG. 13, in another embodiment, the mounting part 211 and the fixing part 212 are separate structures, and the mounting part 211 and the fixing part 212 are detachably connected. In production, the mounting part 211 and the fixing part 212 are respectively processed and shaped, then the atomizing core 22 is mounting in the accommodating cavity 2111 of the mounting part 211, and next the mounting part 211 is mounted on the fixing part 212. The mounting part 211 and the fixing part 212 can be fixedly connected by a buckle structure, or by a riveting structure, or other fixing means, such as screw connection or the like, can also be adopted, as long as the connecting means can maintain the stable connection between the mounting part 212 and the fixing part 212.

Figure 13:
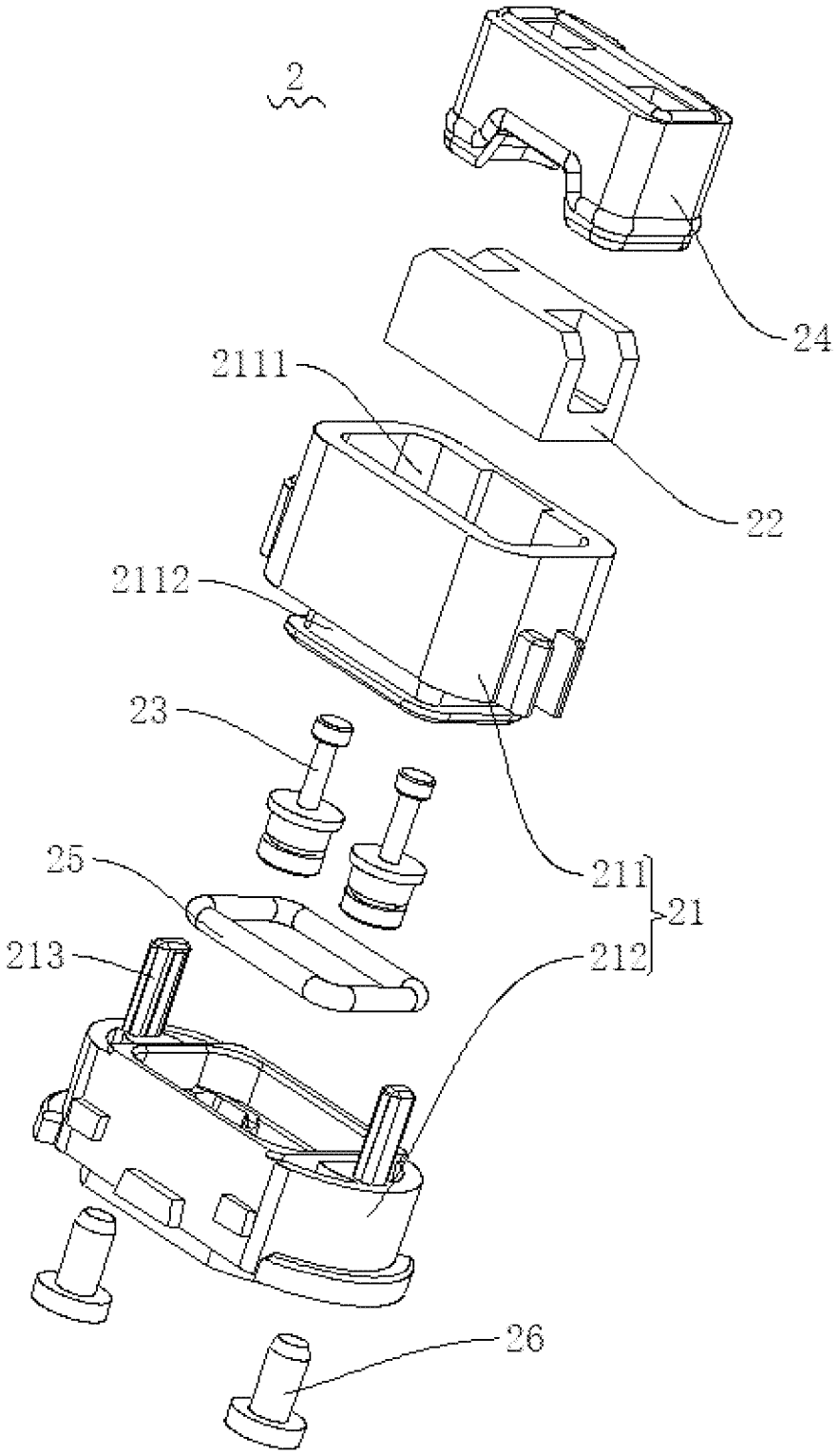
FIG. 13 is a schematic diagram of the exploded structure of the base assembly according to yet another embodiment of the present application.
Figure 14:
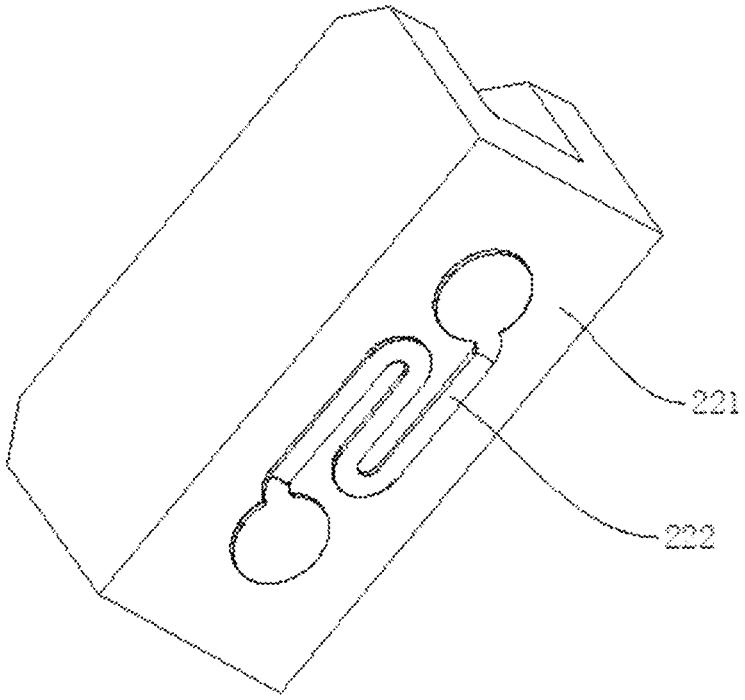
FIG. 14 is a schematic diagram of an atomizing core according to an embodiment of the present application.
Figure 15:
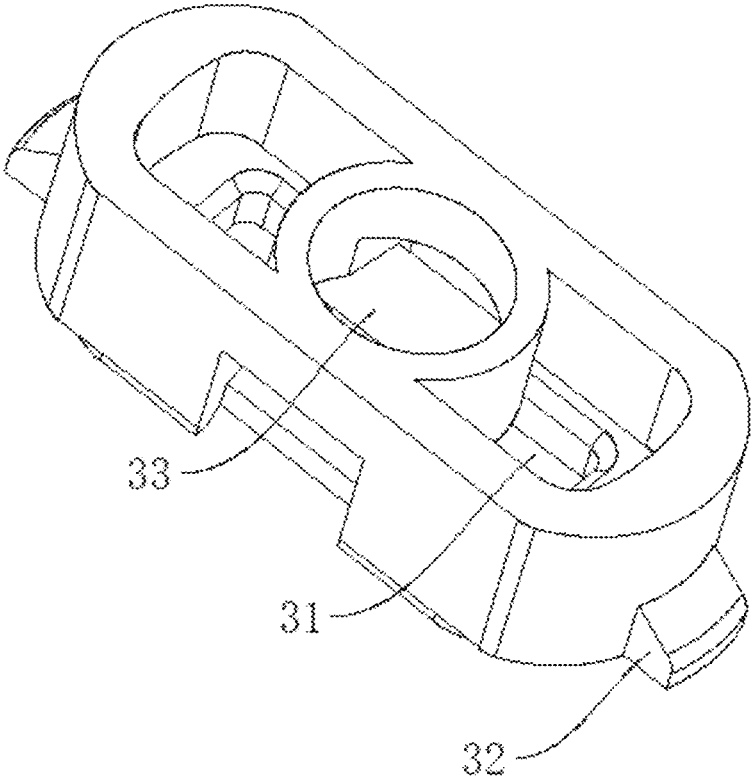
FIG. 15 is a schematic diagram of a fixing frame according to an embodiment of the present application.
Figure 16:
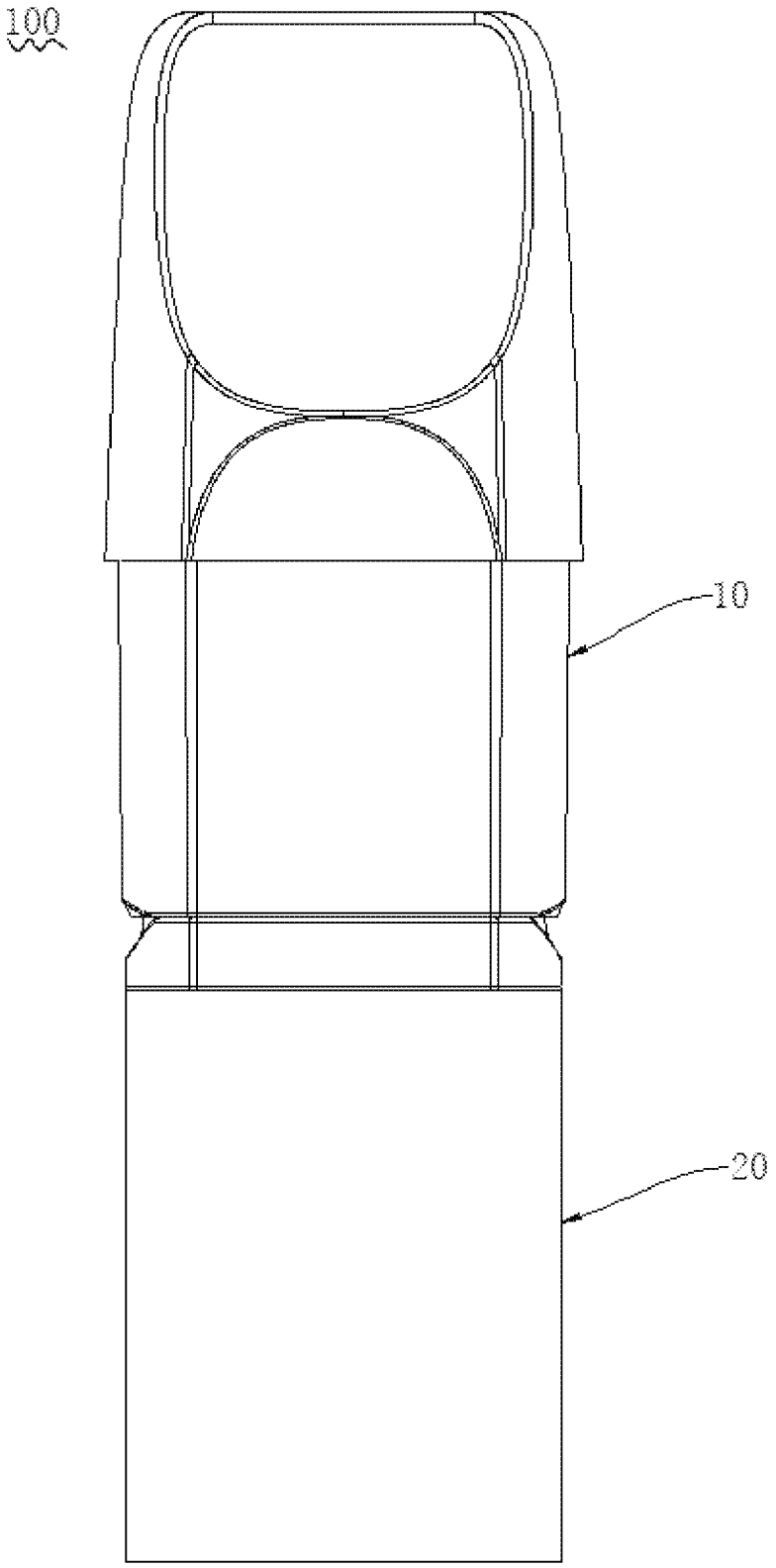
FIG. 16 is a schematic diagram of an electronic cigarette according to an embodiment of the present application.

Furthermore, referring to FIG. 13, the fixing part 212 is provided thereon with a plug arm 2123, and the mounting part 211 is provided thereon with a plug hole 2113 which is matched with the plug arm 2123. In this embodiment, there are two plug arms 2123, and the two plug arms 2123 are respectively arranged on two opposite sides of the fixing part 212, and correspondingly, there are two plug holes 2113. The plug arms 2123 and the plug holes 2113 can realize the fixed connection between the fixing part 212 and the mounting part 211 through interference fit, so as to facilitate the mounting operation.

Referring to FIG. 1 to FIG. 5, in one embodiment, the base assembly 2 further includes a sealing ring 25. An annular mounting groove 2112 is concavely disposed at the peripheral side of the mounting part 211 and the sealing ring 25 is sleeved in the mounting groove 2112. When the mounting part 211 and the fixing part 212 adopt an integrally formed structure, the sealing ring 25 can be inserted into the housing 1 along with the mounting part 211, and the sealing ring 25 abuts against the inner wall of the housing 1, which can play a sealing role to prevent the atomizable liquid from leaking between the inner wall of the housing 1 and the outer wall of the mounting part 211. When the mounting part 211 and the fixing part 212 adopt separate structures, the sealing ring 25 is located between the mounting part 211 and the fixing part 212, which can play a sealing role to prevent the atomizable liquid from leaking between the mounting part 211 and the fixing part 212. In this case, another sealing ring 25 may be arranged at the peripheral side of the fixing part 212 to seal the joint between the housing 1 and the fixing part 212, and prevent the atomizable liquid from leaking between the housing 1 and the fixing part 212.

Referring to FIG. 1 to FIG. 6, in one embodiment, the base 21 is provided with a fixing hole 2121, and one end of the metal thimble 23 is fixed to the fixing hole 2121, and the other end thereof is electrically connected with the atomizing core 22. Specifically, the fixing hole 2121 is formed on the fixing part 212, the fixing hole 2121 penetrates through the fixing part 212, and one end of the metal thimble 23 is inserted into the fixing hole 2121 and exposed on one side surface of the fixing part 212 facing away from the mounting part 211. In this manner, the metal thimble 23 can be electrically connected with the battery assembly 20 or an external power source to supply power to the atomizing core 22. Furthermore, the other end of the metal thimble 23 is electrically connected with the heating element 222 of the atomizing core 22. In this embodiment, the heating element 222 is preferably a printed circuit arranged on the surface of the porous liquid 221, the heating element 222 may be arranged on the porous liquid 221 by screen printing, and the heating element 222 is preferably arranged on one side surface of the porous liquid 221 that is close to the fixing part 212. In this way, electrical connection can be realized simply by making the other end of the metal thimble 23 abut against the heating element 222, which is convenient for installation. During installation, one end of the metal thimble 23 is first mounted into the fixing hole 2121, then the atomizing core 22 is mounted on the mounting part 211, and the heating body 222 of the atomizing core 22 is arranged to abut against the other end of the metal thimble 23. Finally, the fixing part 212 and the mounting part 211 are assembled together to the open end 11 of the housing 1, and the base 21 is fixed onto the housing 1 by the engagement of the clamping protrusion 2131 and the clamping groove 15, thereby completing the assembly.

Referring to FIG. 1 to FIG. 2, in one embodiment, the base assembly 2 further includes a fixing frame 3 and a sealing element 4. The fixing frame 3 and the sealing element 4 are arranged on one side of the oil storage cavity 13 close to the receiving cavity 17, and the sealing element 4 is sleeved on one side of the fixing frame 3 facing away from the receiving cavity 17. Specifically, in this embodiment, the fixing frame 3 is preferably a piece made of plastic, and the sealing element 4 is preferably made of silica gel or rubber. The sealing element 4 and the fixing frame 3 are respectively provided with an oil outlet 41 and an oil guide hole 31 communicating with each other. In the case where the base assembly 2 is in the first state, when the atomizing core 22 is inserted into the receiving cavity 17 and communicates with the oil storage cavity 13, the atomizable liquid in the oil storage cavity 13 sequentially flows through the oil outlet 41 and the oil guide hole 31, and finally flows onto the atomizing core 22 to be heated for generating smoke. Providing the fixing frame 3 with the sealing element 4 sleeved thereon between the atomizing core 22 and the oil storage cavity 13 not only achieves the effect of sealing the oil storage cavity 13 so that the atomizable liquid in the oil storage cavity 13 only flows out from the oil outlet 41 and the oil guide hole 31, but also prevents the atomizable liquid from flowing to other parts in the atomizing device 10, thereby effectively avoiding the oil leakage of the atomizing device 10. Specifically, in order to ensure that the airflow channel 141 communicates with the atomizing cavity 214 when the base assembly 2 is accommodated in the receiving cavity 17, the fixing frame 3 is provided thereon with a first air guide hole 33, and the sealing element 4 is provided thereon with a second air guide hole 42, the first air guide hole 33 communicates with the second air guide hole 42, and the second air guide hole 42 communicates with the airflow channel 141. In this manner, the smoke in the atomizing cavity 214 can flow into the airflow channel 141 after passing through the first air guide hole 33 and the second air guide hole 42, and finally is discharged to the outside of the atomizing device 10 to be inhaled by the user.

Furthermore, referring to FIG. 1 to FIG. 3 and FIG. 15, the fixing frame 3 is provided thereon with a clamping buckle 32, and the inner wall of the housing 1 is concavely provided thereon with a clamping slot 16 matched with the clamping buckle 32. The fixing frame 3 is fixed in the housing 1 through the engagement of the clamping buckle 32 and the clamping slot 16, which not only ensures the stable installation of the fixing frame 3 in the housing 1, but also facilitates the installation operation. Meanwhile, since the fixing frame 3 is fixedly mounted in the housing 1 in advance, and there is no connection relationship between the fixing frame 3 and the base 21, the installation or detachment of the atomizing core 22 together with the base 21 will not affect the stable connection between the fixing member and the housing 1 during the disassembly and assembly of the base 21.

Referring to FIG. 1 to FIG. 6, the atomizing device 10 described above further includes a magnet 26 or a ferromagnetic material which can be magnetically connected with the magnet. The fixing part 212 of the base 21 is provided thereon with a mounting hole 2122 for mounting the magnet 26, and the magnet 26 is fixed in the mounting hole 2122. In this embodiment, the battery assembly 20 is also provided thereon with a magnet 26, and the magnet 26 on the atomizing device 10 and the magnet 26 on the battery assembly 20 attract each other, so as to realize the fixed connection between the atomizing device 10 and the battery assembly 20.

It shall be noted that, the specification and attached drawings of the present application show the preferred embodiments of the present application. However, the present application may be implemented in many different forms, and it is not limited to the embodiments described in this specification. These embodiments are not intended to form additional limitation on the content of the present application, but are provided for a more thorough and comprehensive understanding of the disclosure of the present application. Moreover, the above technical features continue to be combined with each other to form various embodiments not listed above, all of which are regarded as within the scope described in the specification of the present application. Furthermore, those of ordinary skill in the art can make improvements or changes according to the above description, and all these improvements and changes shall fall within the scope claimed in the appended claims of the present application.

What is claimed is:

1. An atomizing device, comprising:

a housing having an oil storage cavity for storing atomizable liquid and a receiving cavity, wherein the receiving cavity communicates with the oil storage cavity, and the oil storage cavity being arranged at one side of the receiving cavity facing away from an open end of the housing; and a base assembly comprising a base and an atomizing core arranged on the base, wherein when the base assembly is in a first state, the base is detachably connected with the housing, and at least a part of the base and the atomizing core are accommodated in the receiving cavity from the open end, and the atomizing core is in fluid communication with the oil storage cavity; and when the base assembly is in a second state, the base is separated from the housing and the atomizing core is disposed outside the housing along with the base;

wherein the base further comprises a mounting part provided with an accommodating cavity and at least one elastic arm;

the atomizing core is arranged in the accommodating cavity;

the mounting part and the at least one elastic arm are separated by a gap; and the base is detachably and elastically connected with the housing through the at least one elastic arm.

2. The atomizing device according to claim 1, wherein the base assembly further comprises a metal thimble, wherein one end of the metal thimble is arranged on the base and the other end the metal thimble abuts against the atomizing core to form an atomizing cavity in the interval between the atomizing core and the inner wall of the base.

3. The atomizing device according to claim 2, wherein the housing further comprises a hollow exhaust pipe with an airflow channel penetrating one end of the housing opposite to the open end, wherein when the base assembly is in the first state, the airflow channel communicates with the atomizing cavity.

4. The atomizing device according to claim 1, wherein the base assembly further comprises an atomizing cover which is arranged on the base and covers the atomizing core.

5. The atomizing device according to claim 1, wherein the base further comprises a fixing part, when the base is in the first state, the fixing part is fixed at the open end and the mounting part is inserted into the receiving cavity.

6. The atomizing device according to claim 5, wherein the mounting part and the fixing part are separate structures, and the mounting part and the fixing part are detachably connected with each other.

7. The atomizing device according to claim 6, wherein the fixing part is provided with a plug arm, and the mounting part is provided with a plug hole matched with the plug arm.

8. The atomizing device according to claim 1, wherein the at least one elastic arm is provided with a clamping protrusion, and the housing is provided with a clamping groove matched with the clamping protrusion.

9. The atomizing device according to claim 1, wherein the atomizing device further comprises a fixing frame and a sealing element, wherein the fixing frame and the sealing element are arranged on one side of the oil storage cavity facing the receiving cavity, and the sealing element is sleeved on one end of the fixing frame facing away from the receiving cavity.

10. The atomizing device according to claim 1, wherein the open end of the housing and the base are in an oblong shape, and the at least one elastic arm comprises two elastic arms, wherein the two elastic arms are oppositely disposed along a length direction of the oblong shape; and the base is detachably and elastically connected with the housing through the two elastic arms.

11. The atomizing device according to claim 1, wherein when the base assembly is in the first state, a recess portion is provided at a joint between the housing and the base; and the recess portion is constructed by at least one inclined part selected from the group consisting of a first inclined part arranged on an outer edge of the base, a second inclined part arranged on an outer edge of the open end of the housing, and any combination thereof.

12. An electronic cigarette, comprising an atomizing device and a battery assembly configured to supply power to the atomizing device;

wherein the atomizing device comprises:

a housing having an oil storage cavity for storing atomizable liquid and a receiving cavity, wherein the receiving cavity communicates with the oil storage cavity, and the oil storage cavity being arranged at one side of the receiving cavity facing away from an open end of the housing; and a base assembly comprising a base and an atomizing core arranged on the base, wherein when the base assembly is in a first state, the base is detachably connected with the housing, and at least a part of the base and the atomizing core are accommodated in the receiving cavity from the open end, and the atomizing core is in fluid communication with the oil storage cavity; and when the base assembly is in a second state, the base is separated from the housing and the atomizing core is disposed outside the housing along with the base;

wherein the base further comprises a mounting part provided with an accommodating cavity and at least one elastic arm;

the atomizing core is arranged in the accommodating cavity;

the mounting part and the at least one elastic arm are separated by a gap; and the base is detachably and elastically connected with the housing through the at least one elastic arm.

13. The electronic cigarette according to claim 12, wherein the base assembly further comprises a metal thimble, wherein one end of the metal thimble is arranged on the base and the other end the metal thimble abuts against the atomizing core to form an atomizing cavity in the interval between the atomizing core and the inner wall of the base.

14. The electronic cigarette according to claim 13, wherein the housing further comprises a hollow exhaust pipe with an airflow channel penetrating one end of the housing opposite to the open end, wherein when the base assembly is in the first state, the airflow channel communicates with the atomizing cavity.

15. The electronic cigarette according to claim 12, wherein the base assembly further comprises an atomizing cover which is arranged on the base and covers the atomizing core.

16. The electronic cigarette according to claim 12, wherein the base further comprises a fixing part, when the base is in the first state, the fixing part is fixed at the open end and the mounting part is inserted into the receiving cavity.

17. The electronic cigarette according to claim 16, wherein the mounting part and the fixing part are separate structures, and the mounting part and the fixing part are detachably connected with each other.

18. The electronic cigarette according to claim 17, wherein the fixing part is provided with a plug arm, and the mounting part is provided with a plug hole matched with the plug arm.

19. The electronic cigarette according to claim 12, wherein the at least one elastic arm is provided with a clamping protrusion, and the housing is provided with a clamping groove matched with the clamping protrusion.

20. The electronic cigarette according to claim 12, wherein the atomizing device further comprises a fixing frame and a sealing element, wherein the fixing frame and the sealing element are arranged on one side of the oil storage cavity facing the receiving cavity, and the sealing element is sleeved on one end of the fixing frame facing away from the receiving cavity.

* * * * *